US007322828B1

(12) United States Patent
Chiang

(10) Patent No.: US 7,322,828 B1
(45) Date of Patent: Jan. 29, 2008

(54) LED SOCKET

(76) Inventor: Chiang Wen Chiang, 3F, No. 10, Lane 83, Sec. 1, Guangfu Rd., Sanchong City, Taipei Hsien (TW)

( * ) Notice: Subject to any disclaimer, the term of this patent is extended or adjusted under 35 U.S.C. 154(b) by 0 days.

(21) Appl. No.: 11/787,283

(22) Filed: Apr. 16, 2007

(51) Int. Cl.
*H01R 12/00* (2006.01)

(52) U.S. Cl. ..... 439/56; 439/619; 439/419; 439/611

(58) Field of Classification Search ..... 439/419, 439/56, 611, 699.1, 699.2, 619
See application file for complete search history.

(56) References Cited

U.S. PATENT DOCUMENTS 2,892,992 A * 6/1959 Grovemiller et al. ..... 439/619
4,365,396 A * 12/1982 Baba et al. ..... 445/22
4,473,770 A * 9/1984 Baba et al. ..... 313/318.12
4,593,958 A * 6/1986 Baba ..... 439/77
5,501,618 A * 3/1996 Muta et al. ..... 439/699.2

* cited by examiner

*Primary Examiner*—Tho D. Ta
(74) *Attorney, Agent, or Firm*—Leong C. Lei

(57) ABSTRACT

An LED socket is detachably mounted on a circuit board in an LED illuminating device. The LED socket has a connector with a lead connecting assembly for connecting an LED and multiple locking protrusions having locking grooves to hold the LED socket in an opening in the circuit board. When an LED breaks or fails, a user can easily detach the LED from the LED illuminating device and conveniently replace it with a new one. As a result, the LED socket in accordance with present invention not only economizes the use of LED, but also makes maintenance and use of the LED illuminating devices easy.

1 Claim, 9 Drawing Sheets

LED SOCKET

BACKGROUND OF THE INVENTION

1. Field of the Invention

The present invention relates to a socket, and more particularly to an LED socket that makes maintenance and use of LED illuminating devices easy.

2. Description of Related Art

Illuminating devices are used in virtually every place of people's lives and various types such as incandescent bulbs, fluorescent lamps have been developed since the invention of the incandescent filament in 1878. Currently, light-emitting diodes (LEDs) have become a popular source of illumination because of their high luminescence and resultant low temperature and improved electrical efficiency and are replacing conventional illuminating devices in all kinds of applications.

With reference to FIG. 9, an example of an LED illuminating device is an LED illuminating tube (50) that comprises a transparent tube (51), two brackets (53), a circuit board (52) and multiple LEDs (54). The transparent tube (51) has two open ends. The brackets (53) are mounted respectively in the open ends of the transparent tube (51) and electrically connect to an external power resource. The circuit board (52) is mounted longitudinally in the transparent tube (51) and has a mounting surface and two ends. The ends are attached securely respectively to the brackets (53) and communicate with the power resource. The LEDs (54) are mounted securely in a line on the mounting surface of the circuit board (52), and each LED (54) has two leads (540) connected directly to the mounting surface of the circuit board (52) to conduct electricity to the LED (54).

Accordingly, individual LEDs (54) are inconvenient to detach from the circuit board (52). If one of the LEDs (54) breaks or fails, changing the broken or failed LED (54) is difficult, at best, and quite likely impossible, especially for a general consumer, which usually requires discarding and replacing the entire LED illuminating tube (50). This not only wastes LEDs, but also makes the LED illuminating devices inconvenient to use.

To overcome the shortcomings, the present invention provides an LED socket to obviate or mitigate the aforementioned problems.

SUMMARY OF THE INVENTION

The main objective of the present invention is to provide an LED socket that detachably holds an LED and is detachably mounted on a circuit board in an LED illuminating device such that when an LED breaks or fails, the LED can be removed easily from the LED illuminating device and conveniently replaced with a new one.

As a result, the LED socket in accordance with the present invention not makes use of LED more economical, but also makes maintenance and use of the LED illuminating devices easy.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
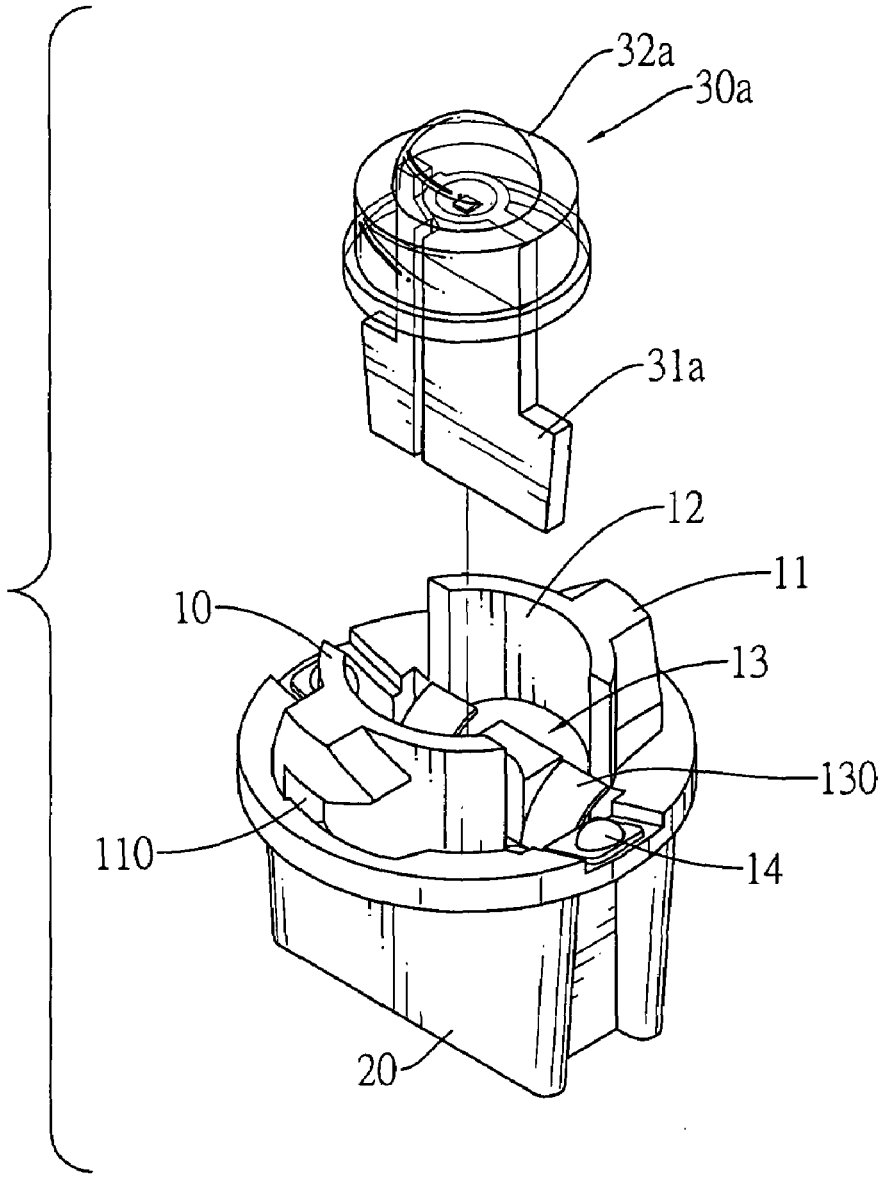
FIG. 1 is an exploded perspective view of a first embodiment of an LED socket in accordance with the present invention and an LED.
Figure 2:
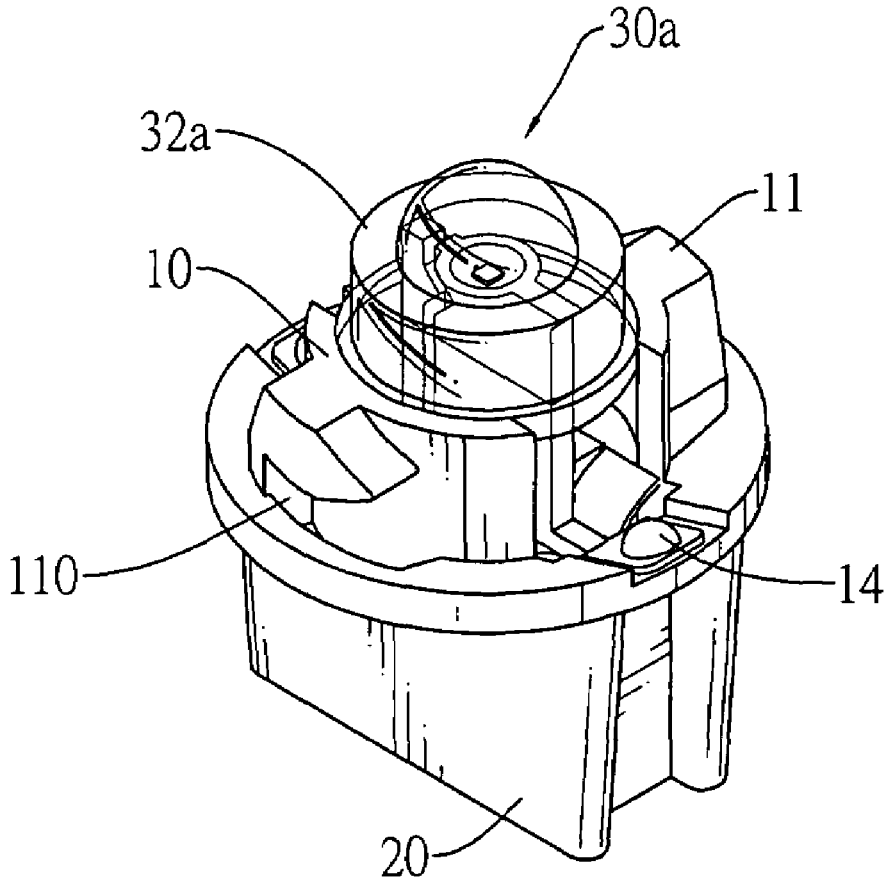
FIG. 2 is a perspective view of the LED socket and the LED in FIG. 1.
Figure 3:
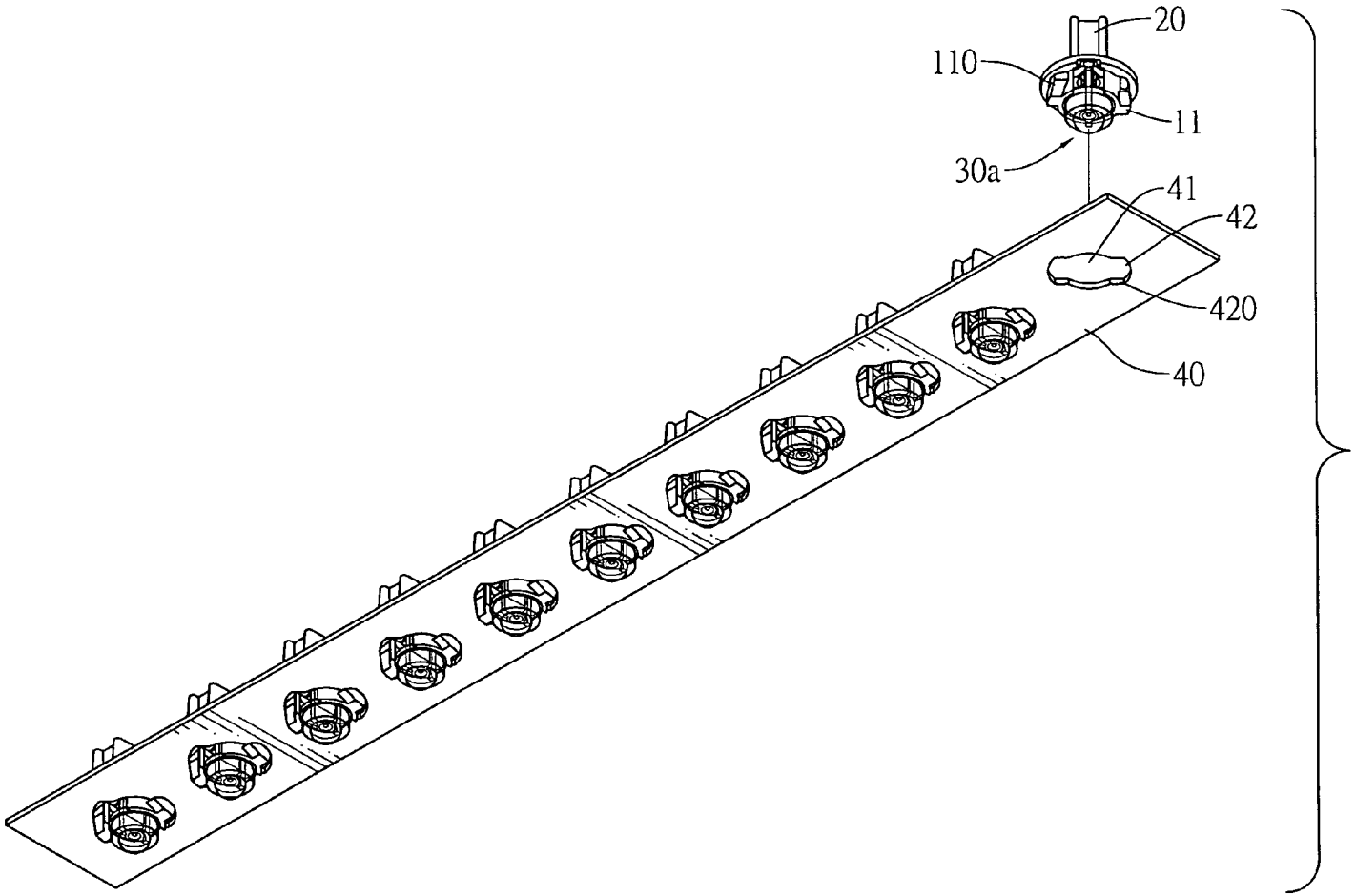
FIG. 3 is a partially exploded operational perspective view of multiple LED sockets in FIG. 1 mounted respectively in openings in a circuit board of an LED illuminating tube.

With reference to FIGS. 1, 2, 3, 5, 6, 7 and 8, an LED socket in accordance with present invention connects to a circuit board (40, 40'), removably holds an LED (30*a*, 30*b*, 30*c*, 30*d*), connects the LED (30*a*, 30*b*, 30*c*, 30*d*) to the circuit board (40, 40') and has a body, a knob (20) and a connector (10). The LED (30*a*, 30*b*, 30*c*, 30*d*) may be packaged as a first, second, third or fourth type.

The first type of LED (30*a*) comprises an LED assembly (32*a*) and two leads (31*a*). The LED assembly (32*a*) emits light when energized and has a bottom surface. The leads (31*a*) are spade-type leads and are mounted on and protrude longitudinally from the bottom surface of the LED assembly (32*a*).

The second type of LED (30*b*) is similar to the first type of LED (30*a*) and comprises an LED assembly (32*b*) and two leads (31*b*). The LED assembly (32*b*) emits light when energized and has a bottom surface. The leads (31*b*) are also spade-type leads and are mounted on and protrude longitudinally from the bottom surface of the LED assembly (32*a*), but one of the leads (31*b*) has a transverse through hole.

The third type of LED (30*c*) comprises an LED assembly (32*c*) and four leads (31*c*). The LED assembly (32*c*) emits light when energized and has a bottom surface. The leads (31*c*) are mounted separately on and protrude longitudinally from the bottom of the LED assembly (32*c*).

The fourth type of LED (30*d*) comprises an LED assembly (32*d*) and two leads (31*d*). The LED assembly (32*d*) emits light when energized and has a bottom surface. The leads (31*d*) are also spade-type leads and are mounted on and protrude longitudinally from the bottom of the LED assembly (32*c*) parallel to each other, and each lead (31*d*) has two longitudinal edges.

The body has a front surface, a rear surface and two contacts (14). The front surface has a center, a central area and an outer area. The contacts (14) are formed opposite to each other on the front surface in the outer area and are metal such as copper or iron.

The knob (20) is formed on and protrudes from the rear surface of the body and allows a person to rotate the LED socket easily.

The connector (10) is formed on and protrudes longitudinally from the front surface around the central area and has an inner surface, a connecting hole (12), a lead connecting assembly (13, 13'), multiple optional guide grooves (15) and two locking protrusions (11).

The connecting hole (12) is formed in the center of the front surface.

The lead connecting assembly (13, 13') is mounted in the connecting hole (12), electrically communicates with the contacts (14) of the body and may have multiple lead clamps (130) and multiple sockets (131).

Figure 7:
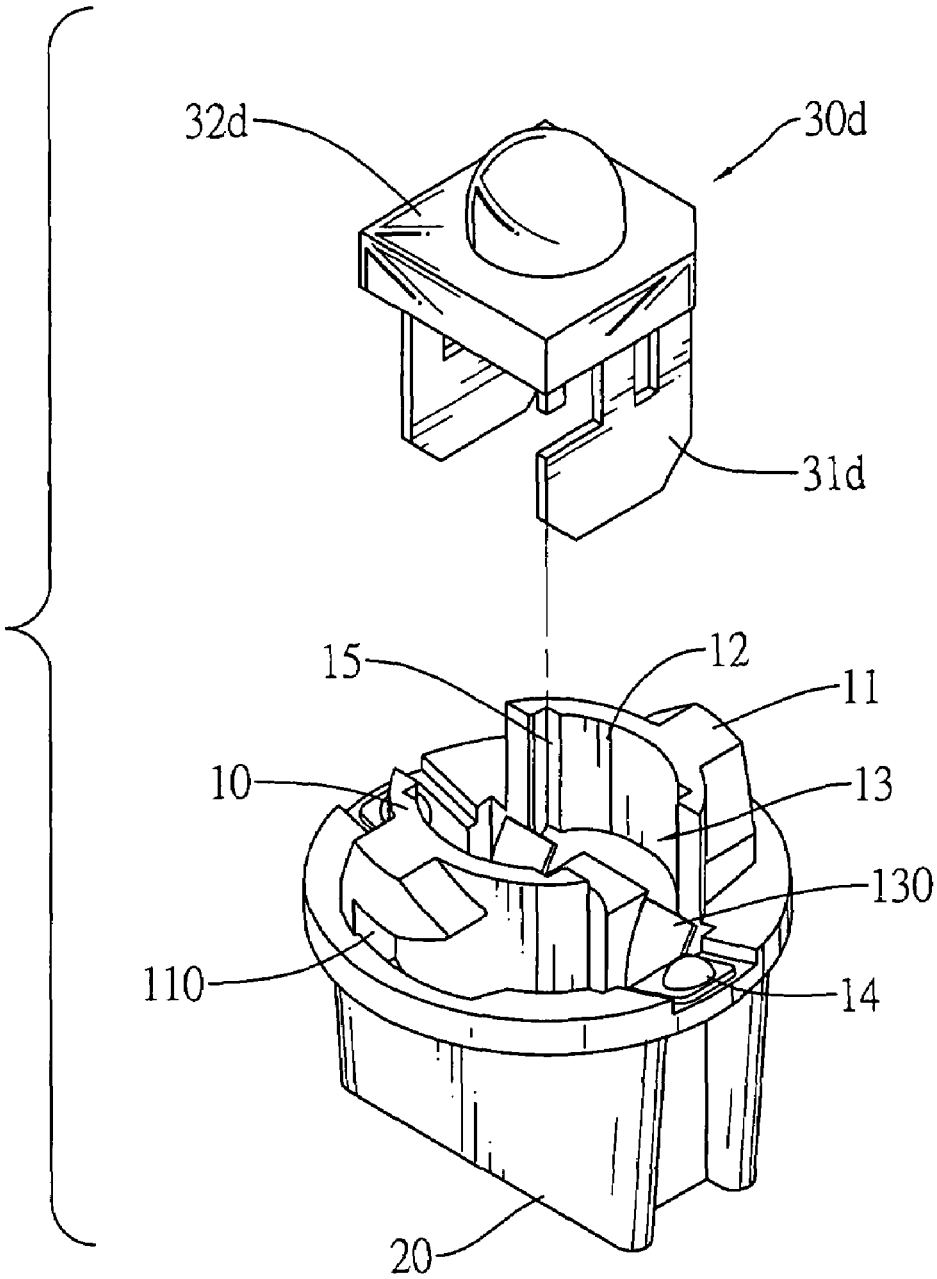
FIG. 7 is an exploded perspective view of a third embodiment of an LED socket in accordance with the present invention and an LED.
Figure 8:
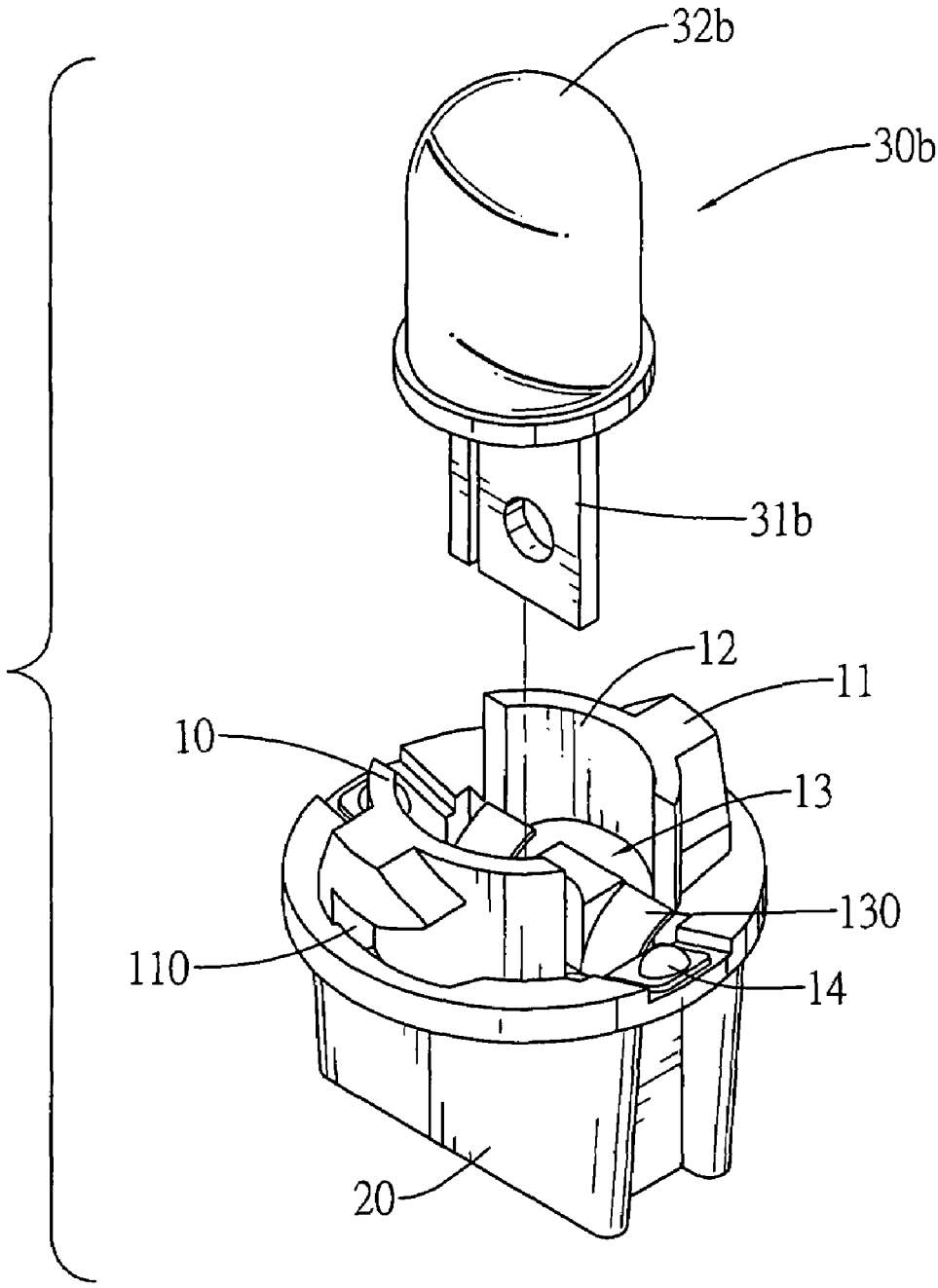
FIG. 8 is an exploded perspective view of the first embodiment of the LED socket in FIG. 1 and another LED.
Figure 9:
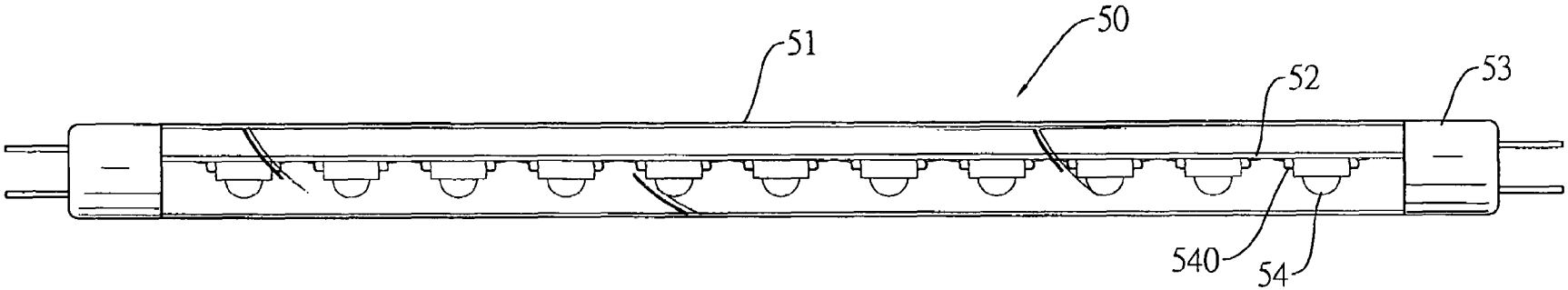
FIG.9 PRIOR ART
FIG. 9 is a side view of a conventional LED illuminating tube in accordance with the prior art.

The lead clamps (130) are mounted in the connecting hole (12), and each lead clamp (130) comprises two resilient metal strips. The resilient metal strips are parallel and opposite to each other and press against each other, and each resilient metal strip electrically connects to one of the contacts (14) of the body and has a distal end. The distal end extends into the connecting hole (12) and presses against the distal end of the adjacent resilient metal strip. With further reference to FIG. 7, a first and a third embodiment of an LED socket in accordance with the present invention have a lead connecting assembly (13) that has two lead clamps (130).

The sockets (131) are separately mounted in the connecting hole (12). Each socket (131) has a top and an inserting hole. The inserting hole has a slightly tapered inner surface formed longitudinally in the top of the inserting hole. In a second embodiment of the LED socket in accordance with the present invention, the lead connecting assembly (13') has four sockets (131).

The guide grooves (15) are formed longitudinally in the inner surface of the connector (10), and each two are diametrically opposite to each other.

The locking protrusions (11) are formed on and protrude transversely from the connector (10) between the contacts (14), and each locking protrusion (11) has an outer surface and a locking groove (110). The locking groove (110) is formed in the outer surface of the locking protrusions (11) in a converse direction relative to the locking groove (110) of the other locking protrusion (11).

Figure 4:
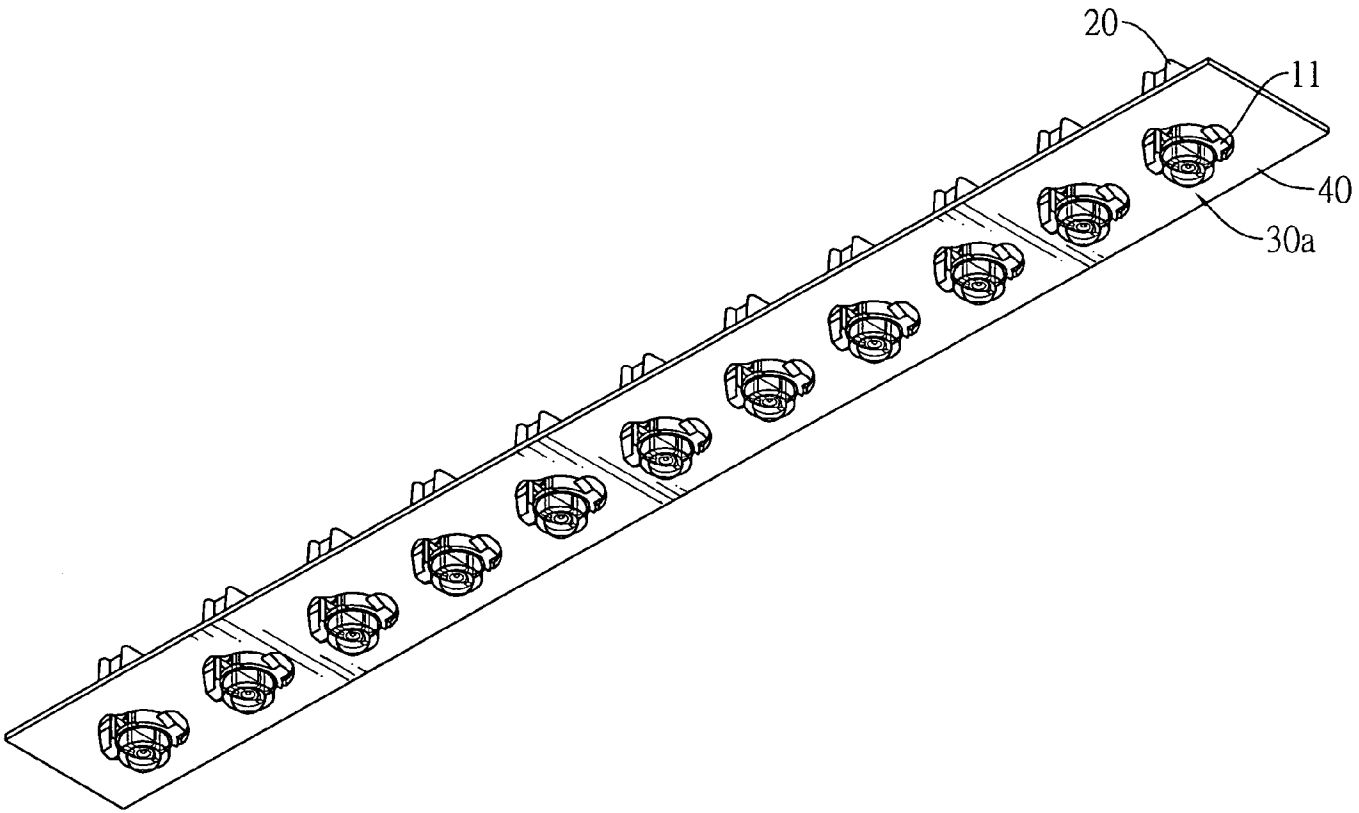
FIG. 4 is an operational perspective view of the LED sockets in FIG. 1 mounted on the circuit board of an LED illuminating tube.
Figure 5:
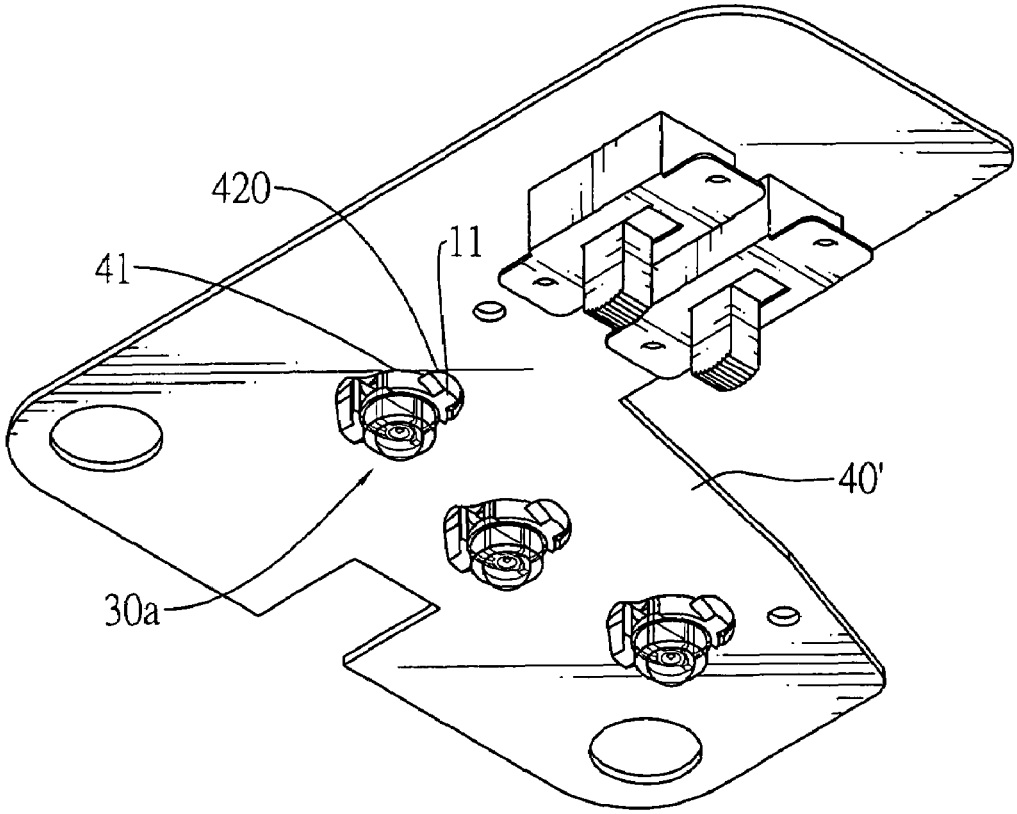
FIG. 5 is an operational perspective view of the LED socket in FIG. 1 mounted on a circuit board of another LED illuminating device.
Figure 6:
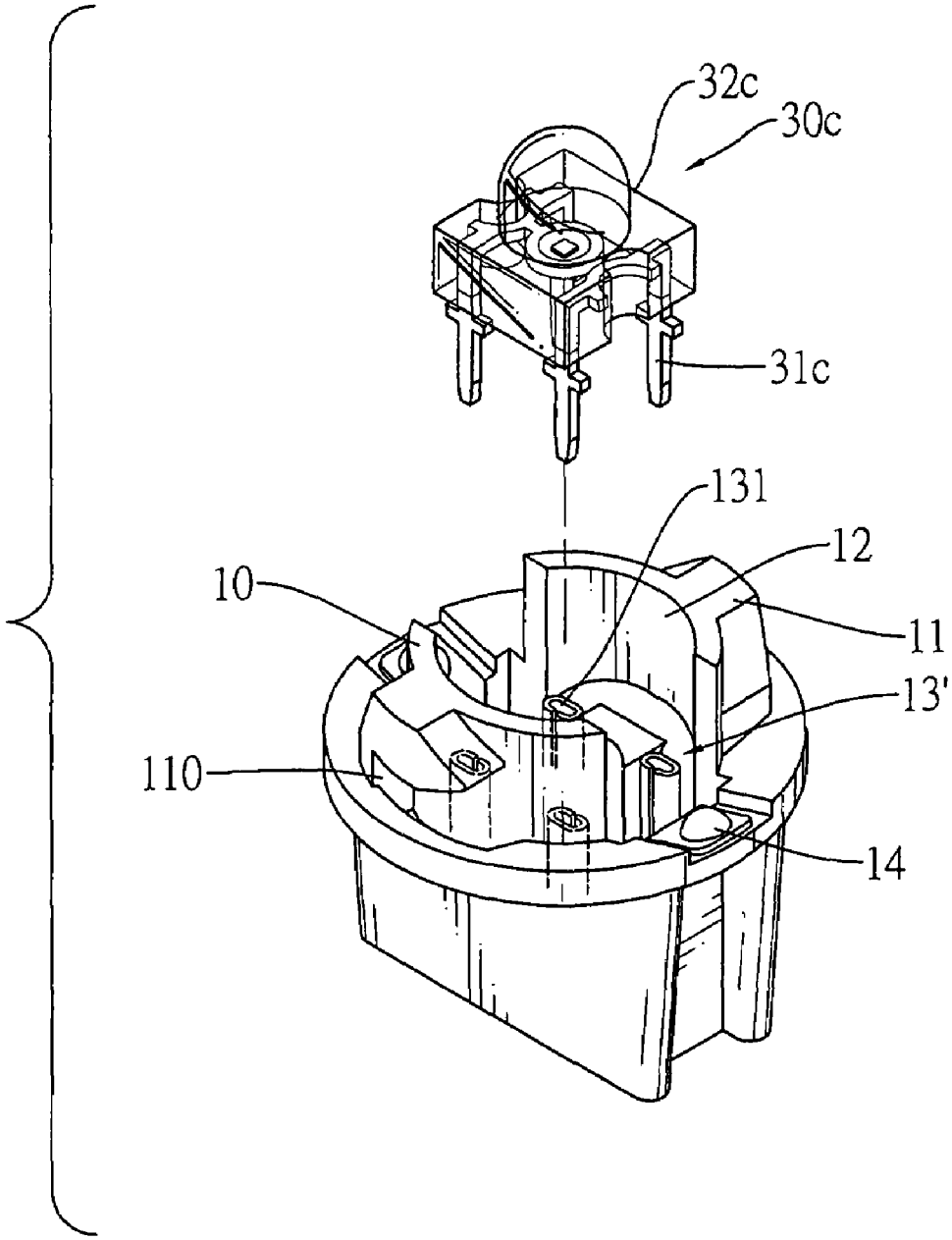
FIG. 6 is an exploded perspective view of a second embodiment of an LED socket in accordance with the present invention and an LED.

With further reference to FIGS. 4 and 5, the LED sockets are mounted detachably respectively in openings (41) in the circuit boards (40,40') of an LED illuminating tube and an automobile LED illuminating device. The openings (41) are formed through the circuit boards (40, 40'), and each opening (41) is essentially circular, corresponds to the connector (10) of an LED socket and has an edge and two recesses (42). The recesses (42) are formed radially in the edge of the opening (41) diametrically opposite to each other, correspond respectively to the locking protrusions (11) of the LED socket and allow the connectors (10) to be mounted detachable respectively in the openings (41). Each recess (42) has an inner edge (420) to engage the locking groove (110) on the corresponding locking protrusion (11) when the LED socket is mounted in the opening (41) and rotated by the user.

Accordingly, if one of the LEDs (30*a*, 30*b*, 30*c*, 30*d*) is broken, the user can rotate the LED socket and disengage the threaded protrusions (11) from the recesses (42) of the opening (41), such that the LED socket can be removed from the circuit board (40, 40') and the user can directly remove the broken LED (30*a*, 30*b*, 30*c*, 30*d*) from the connecting hole (12) and plug in a new one.

As a result, the LED socket in accordance with present invention not only ensures economical use of LEDs, but also makes maintenance and use of the LED illuminating devices easy.

Even though numerous characteristics and advantages of the present invention have been set forth in the foregoing description together with details of the structure and function of the invention, the disclosure is illustrative only. Changes may be made in detail especially in matters of shape, size and arrangement of parts within the principles of the invention to the full extent indicated by the broad general meaning of the terms in which the appended claims are expressed.

What is claimed is:

1. An LED socket comprising:

a body having a front surface, said front surface having a center, a central area, and an outer area;

a rear surface; and a connector being formed on and protruding longitudinally from the front surface around the central area and having an inner surface;

a connecting hole being formed in the center of the front surface;

a lead connecting assembly being mounted in the connecting hole and electrically communicating with contacts of the body; and two locking protrusions being formed on and protruding transversely from the connector between the contacts, and each locking protrusion having an outer surface, and a locking groove being formed in the outer surface in a converse direction relative to the locking groove of the other locking protrusion;

wherein the body further has two contacts being formed opposite to each other on the front surface in the outer area, the lead connecting assembly has multiple lead clamps being mounted in the connecting hole, and each lead clamp comprising two resilient metal strips parallel and opposite to each other and pressing against each other, and each resilient metal strip electrically connecting to one of the contacts of the body and having a distal end extending into the connecting hole and pressing against the distal end of the adjacent resilient metal strip, the lead connecting assembly further has multiple sockets being separately formed on the connecting hole, and each socket having a top, and an inserting hole having a slightly tapered inner surface formed longitudinally in the top, the connector further has multiple guide grooves being formed longitudinally in the inner surface of the connector and each two being diametrically opposite to each other, a knob being formed on and protruding from the rear surface of the body.

* * * * *